US007520289B1

(12) United States Patent
Barber

(10) Patent No.: US 7,520,289 B1
(45) Date of Patent: Apr. 21, 2009

(54) CAFE UMBRELLA MECHANISM

(75) Inventor: James N Barber, Ocala, FL (US)

(73) Assignee: Shade Systems Inc., Ocala, FL (US)

( * ) Notice: Subject to any disclaimer, the term of this patent is extended or adjusted under 35 U.S.C. 154(b) by 0 days.

(21) Appl. No.: 11/972,571

(22) Filed: Jan. 10, 2008

(51) Int. Cl.
*A45B 17/00* (2006.01)
*A45B 25/14* (2006.01)

(52) U.S. Cl. ..... 135/21; 135/20.3; 135/98

(58) Field of Classification Search ..... 135/16, 135/21, 20.3, 98, 90; 248/317, 218.4, 219.2, 248/283.1, 118.3; 473/483–484, 479
See application file for complete search history.

(56) References Cited

U.S. PATENT DOCUMENTS 3,486,514 A * 12/1969 Prescott ..... 135/90
4,606,366 A * 8/1986 Collet ..... 135/20.1
5,116,258 A 5/1992 Vennick
5,678,585 A * 10/1997 May ..... 135/20.1
5,785,069 A 7/1998 Glatz
6,014,980 A * 1/2000 Glatz ..... 135/20.1
6,152,156 A * 11/2000 Tung ..... 135/21
6,220,261 B1 * 4/2001 Glatz ..... 135/20.3
6,321,763 B1 11/2001 Ma
6,478,037 B2 * 11/2002 Tung ..... 135/21
6,662,815 B2 12/2003 Tung
6,926,019 B2 * 8/2005 Glatz ..... 135/20.3
6,953,043 B2 10/2005 Yu
6,988,504 B1 1/2006 Goldwitz
7,134,442 B2 * 11/2006 Ma ..... 135/20.1
2006/0201542 A1 * 9/2006 Ma ..... 135/20.3

FOREIGN PATENT DOCUMENTS

DE 3229776 A1 * 4/1983
EP 466661 A1 * 1/1992
EP 1550383 A1 * 7/2005

* cited by examiner

*Primary Examiner*—Winnie Yip
(74) *Attorney, Agent, or Firm*—David Kiewit

(57) ABSTRACT

A support apparatus for a café umbrella has a support arm pivotally attached to a generally vertical pole. In a preferred uneven-arm arrangement, a canopy-supporting end of the arm is further to one side of the pole than a second, actuator-connected end of the arm is to the other side of the pole. An actuator mechanism connected between the pole and the shorter portion of the arm and can be used to raise or lower the canopy supporting end of the arm by moving the second end of the arm respectively toward or away from the pole. A cable assembly runs along the length of the support arm so that one end hangs beneath the canopy supporting end of the arm where it can retain a removable canopy. The other end of the cable assembly is attached to the pole so that when the actuator draws the arm toward the pole and raises its canopy-supporting end, the free end of the cable moves downward so as to collapse the canopy.

10 Claims, 5 Drawing Sheets

CAFE UMBRELLA MECHANISM

BACKGROUND OF THE INVENTION

1. Field of the Invention

The invention relates to mechanically operated umbrellas having an axially offset support.

2. Background Information

Café umbrellas commonly use an axially offset support pole and a laterally extending support arm to hold up a collapsible canopy. A variety of mechanisms have been proposed for mechanically opening and closing the canopy. Some of these mechanisms are configured to move the canopy closer to the support pole as it is closed so as to provide a more compact and attractive storage arrangement.

Some known mechanisms for opening and closing a café umbrella require a carriage or traveler that is attached to one end of a movable arm and that slides along a fixed arm. These arrangements are problematic in that avoiding excess sliding friction may involve either lubricating an external surface with materials that can soil clothing, or employing slotted support arms and internal carriages that can post a pinch hazard. Examples of such mechanisms have been taught by Glatz in U.S. Pat. No. 5,785,069, by Goldwitz in U.S. Pat. No. 6,988,504, by Ma in U.S. Pat. No. 6,321,763, and by Vennick in U.S. Pat. No. 5,116,258.

BRIEF SUMMARY OF THE INVENTION

One aspect of the invention is that It provides a mechanism for opening and closing a café umbrella by means of a single crank-operated winch, where the mechanism does not have recourse to sliding a load-bearing arm along another portion of the apparatus.

The invention provides a café umbrella assembly comprising a support arm pivotally attached to an upstanding pole near the top of the pole. In a preferred uneven-arm arrangement, a canopy-supporting end of the arm is further to one side of the pole than a second, actuator-connected end of the arm is to the other side of the pole. An actuator mechanism is connected between the pole and the shorter portion of the arm and is operable to selectively raise or lower the canopy supporting end of the arm by moving the second end of the arm respectively toward or away from the pole. A cable assembly preferably runs along the length of the support arm. One end of the cable assembly hangs beneath the canopy supporting end of the arm and is used to retain a removable canopy. The other end of the cable assembly is attached to the pole.

A preferred embodiment of the invention provides an umbrella supporting apparatus comprising an upstanding pole, a tubular support arm pivotally attached to the pole, a winch attached to the pole and operable to pivot the arm with respect to the pole, and a cable assembly comprising a tied-off end cable, a runner cable and a pulley arrangement. In a preferred cable assembly, one end of the tied-off end cable is attached to a base plate portion of the winch and the other, movable, end is attached to the pulley assembly. The runner cable, on the other hand, extends from the pulley arrangement to a canopy-engaging end that hangs down from the canopy-supporting end of the support arm. The pulley arrangement may have many forms characterized in that a displacement of the portion of the arrangement to which the fixed end cable is attached is accompanied by a greater displacement of the free end of the runner cable.

Although it is believed that the foregoing rather broad summary description may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed in the following Detailed Description as a basis for designing other arrangements for carrying out the same purposes of the present invention and that such equivalent constructions are within the spirit and scope of the invention in its broadest form. Moreover, it may be noted that different embodiments of the invention may provide various combinations of the recited features and advantages of the invention, and that less than all of the recited features and advantages may be provided by some embodiments.

DETAILED DESCRIPTION OF A PREFERRED EMBODIMENT

Figure 2:
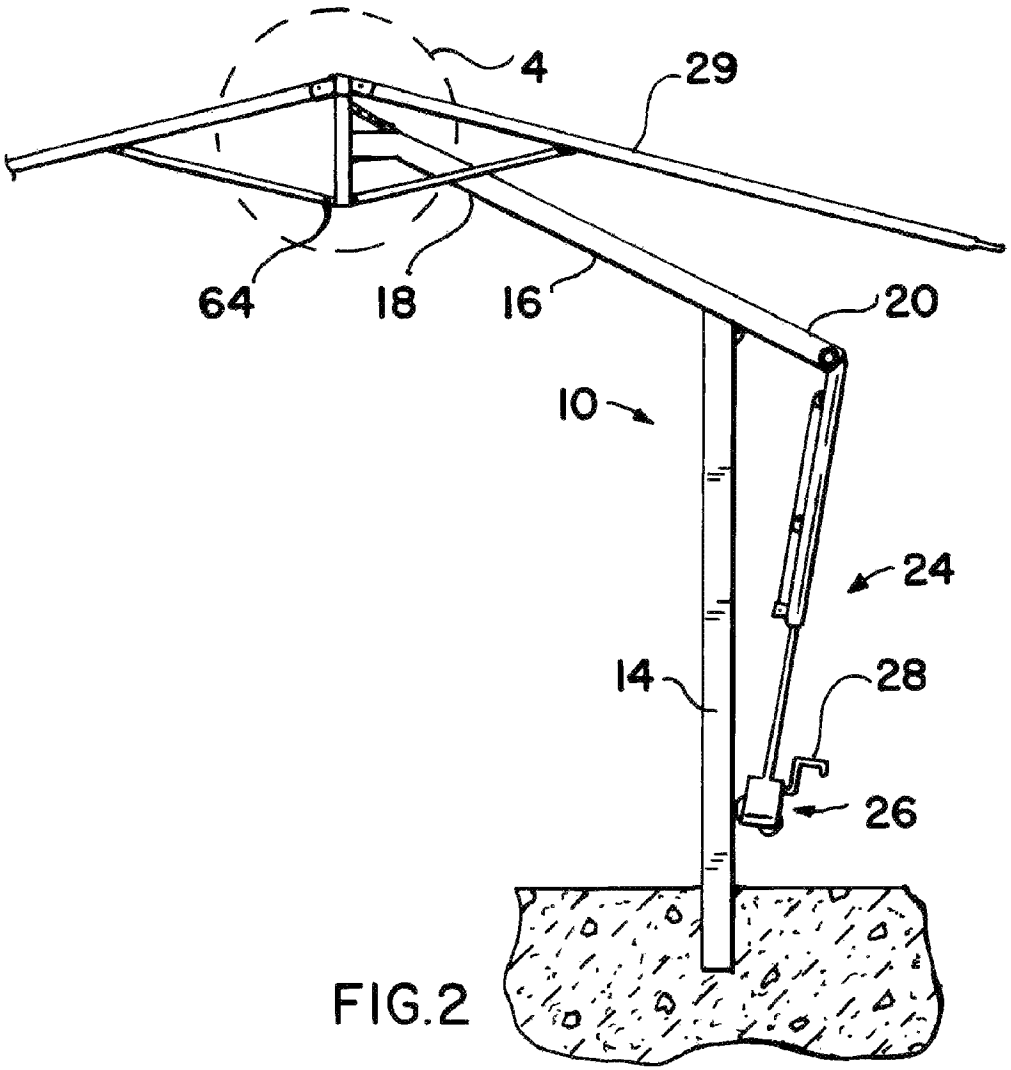
FIG. 2 is an elevational view of the apparatus of FIG. 1 in a second position in which the support arm is lowered and a canopy supported by the apparatus is open.

In studying this Detailed Description, the reader may be aided by noting definitions of certain words and phrases used throughout this patent document. Wherever those definitions are provided, those of ordinary skill in the art should understand that in many, if not most instances, such definitions apply to both preceding and following uses of such defined words and phrases. Generally speaking, the invention involves a pivoted support arm having two ends characterized as a 'canopy-supporting' end and an 'actuator-connected' end. The reader will recognize the term 'canopy-supporting' is used even in situations in which no canopy is present. Moreover, the actuator-connected end generally has an actuator attached near the end thereof, but not necessarily at that end. Additionally, the word 'cable' should be read as standing for any sort of suitable flexible member. This includes, without limitation, wire rope, chains of various sorts, ropes made from natural or synthetic organic fibers, and belts made from any suitable material. One portion of a cable assembly, which may comprise one or more cables, is referred to as a 'tied-off cable', which has one end affixed to a support member or looped thereabout as is conventional in attaching a flexible member to an anchor point. Another portion of a cable assembly is referred to as a 'runner cable' inasmuch as one end of that cable (called a free end or a knot bead end) can be used to engage a canopy runner.

The first two figures of the drawing provide external views of a preferred café umbrella support apparatus 10 of the invention. The apparatus of this embodiment comprises a base 12 supporting an upstanding, and preferably vertically disposed, pole 14 to which a support arm 16 is preferably unevenly pivotally attached at or adjacent an upper end of the pole 14 so that a longer, canopy-supporting portion 18 extends to one side and a shorter, actuator-connected portion 20 extends to the other side of the pole 14. The actuator-connected end of the arm 16 is connected to the pole 14 by means of an actuator 22 operable to move the actuator-connected end of the arm toward or away from the pole so as to respectively raise and lower the canopy-supporting end of the arm 16.

In a preferred embodiment the actuator 22 comprises a telescoping strut 24 and a winch 26 operable by a hand crank 28 to either shorten or lengthen the strut 24 as will be disclosed in greater detail subsequently herein. The reader will appreciate that many other approaches to driving the actuator-connected end of the arm 16 toward and away from the pole 14 can be considered. These include, but are not limited to pneumatic or hydraulic cylinders, and a wide variety of electrical linear actuators. Moreover, the reader will recognize that if the canopy 29 that is used is heavy enough, one could choose to rely on the force of gravity to move the canopy-supporting end of the arm 16 downward and could elect to use an actuator that supplies a driving force in only one direction, such as a simple winch and cable arrangement, to raise the canopy-supporting end 18 of the arm 16.

Figure 3:
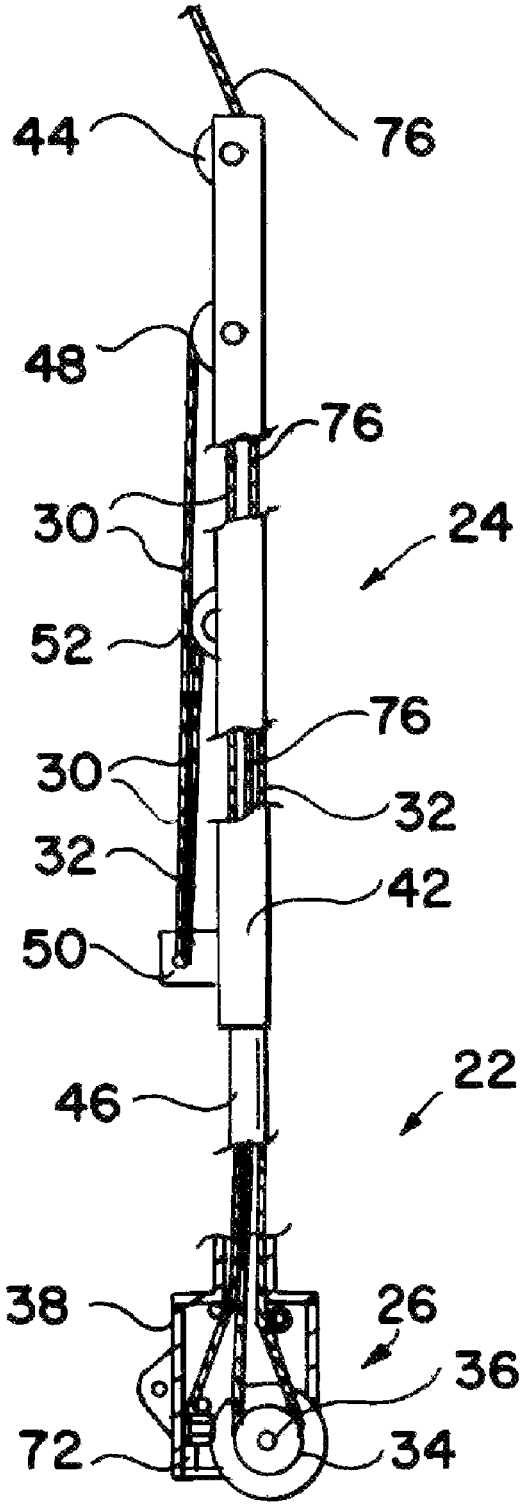
FIG. 3 is partly cut-away view of a preferred actuator comprising a winch and a strut assembly.

A particular preferred actuator arrangement employing a telescopable strut 24, a winch 26 and two winch cables 30, 32 is depicted in detail in FIG. 3. The winch 26 comprises a winch spool 34 journaled for rotation about a winch axle 36 affixed to a winch base 38 that, in turn, is pivotally connected to the pole 14 so that the angle between the strut and the pole can vary as the support arm is moved. The preferred embodiment is configured to provide driving forces to both extend and retract the strut. A worm-gear arrangement (not shown) is used to selectively turn the winch spool 24 in either of the two possible rotary directions.

The depicted strut 24 comprises an upper tube 42 pivotally attached by means of an axle of a first supporting-arm idler pulley 44 to the actuator-connected end 20 of the support arm 16 and enveloping part of a lower tube 46 that is fixedly attached, at its lower end, to the winch base 38. An upper strut pulley 48 and a strut anchor tab 50 are attached to the upper strut tube 42. A retraction winch cable 30 extends from the winch spool 34 over the upper strut pulley to the anchor tab 50 so that when the winch spool 34 is rotated in one of the two possible rotary directions the retraction cable 30 is shortened and the anchor tab 50 is drawn closer to the upper strut pulley 48, thus causing the upper strut tube 42 to move downwards over the lower strut tube 46. The extension winch cable 32 extends from the winch spool 34 over a lower strut pulley 52 to the anchor tab 50. The lower strut pulley is attached to the lower strut tube 46 and extends through a suitable slot in the upper strut tube. When the winch spool 34 is rotated in the other rotary direction, the extension tube is shortened, which draws the anchor tab 50 toward the lower strut pulley 52, thus causing the upper strut tube 42 to move upwardly so as to extend the strut.

The reader will recognize that many of the design features mentioned in the foregoing description of strut operation are matters of convenience and that many other arrangements could be used to provide a strut having a controllable length.

Although the preferred embodiment of the café umbrella 10 of the invention employs a weighted base 54 the reader will appreciate that other approaches to retaining the pole in a generally vertical and upstanding orientation could also be used. These include, but are not limited to burying a portion of the pole in the earth or embedding it in concrete.

Figure 4:
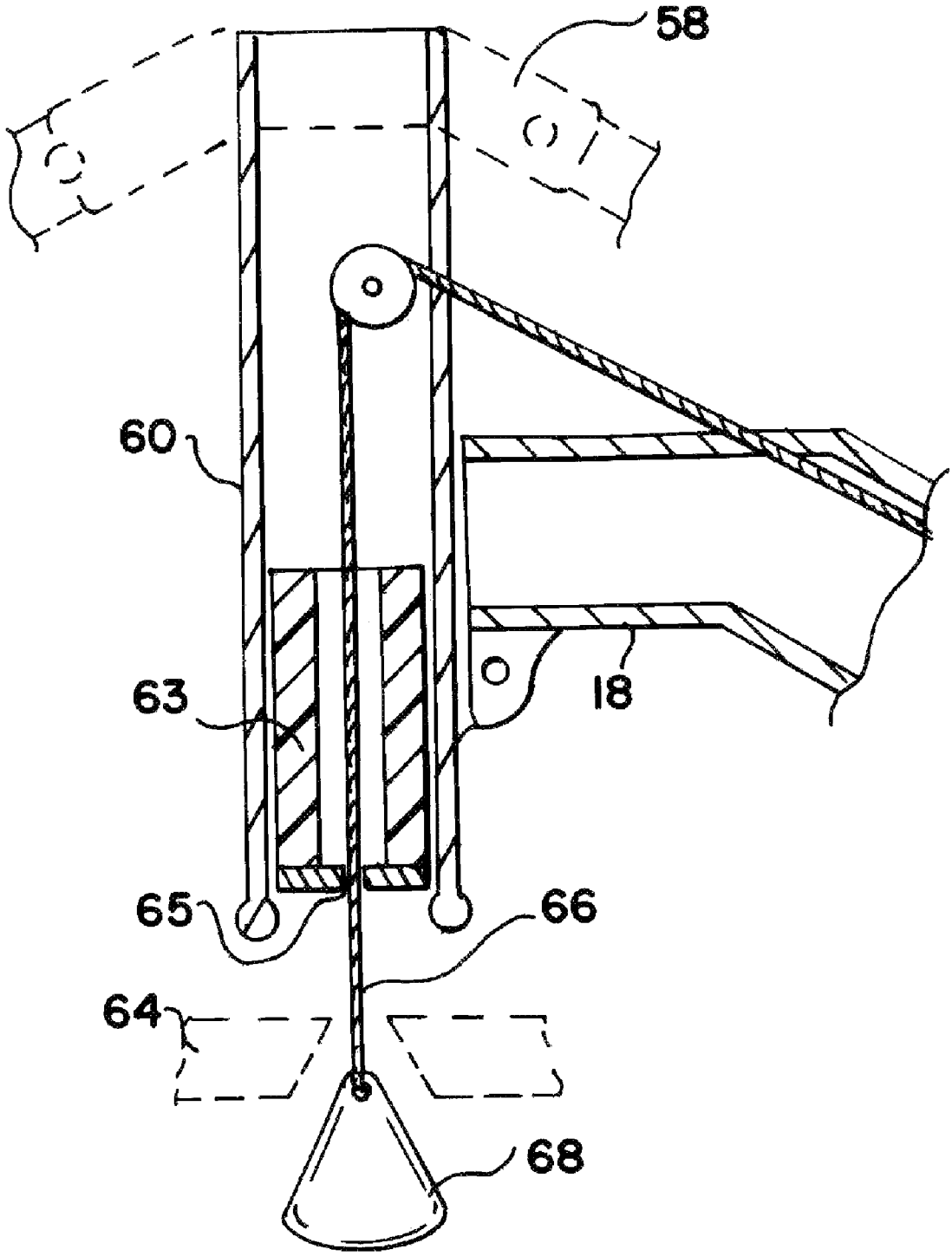
FIG. 4 is a detailed sectional view of a preferred canopy hub assembly indicated by the numeral 4 in FIG. 2.

A canopy 29, or umbrella, that may be employed with the depicted apparatus of the invention commonly comprises ribs 56 for supporting a flexible panel (not shown). In the preferred embodiment depicted in FIG. 4 the ribs 56 extend from a crown 58 attachable to a hub tube 60 that is pivotally connected to a canopy-supporting end 18 of the support arm 16. Stretchers 62 are pivotally connected to the ribs 56 and to a runner 64 that is movable with respect to the crown 58 for opening or closing the umbrella 29. A free end of a runner cable 66 extends through both a slidable guide tube 63 and a central bore in the runner 64 and is terminated at a knot bead 68. Pulling the knot bead 68 upward forces the runner 64 toward the crown 58, which opens the canopy 29. Correspondingly, moving the knot bead 68 away from the support arm 16 allows the runner to fall away from the crown so that the canopy collapses.

The slidable guide tube 63 keeps the cable end 66 axially centered in the hub tube 60 to ensure smooth operation. When the knot bead is fully raised it can engage the guide tube 63 and push it upwards while keeping the cable centered. When the knot bead 68 is most distal from the hub tube 60 the guide tube 63 falls downward so that its centering guide portion 65 is about one half inch from the bottom of the hub tube 60. This arrangement has been found to be better than simply using a fixed guide aperture in the bottom of the hub tube.

Figure 5:
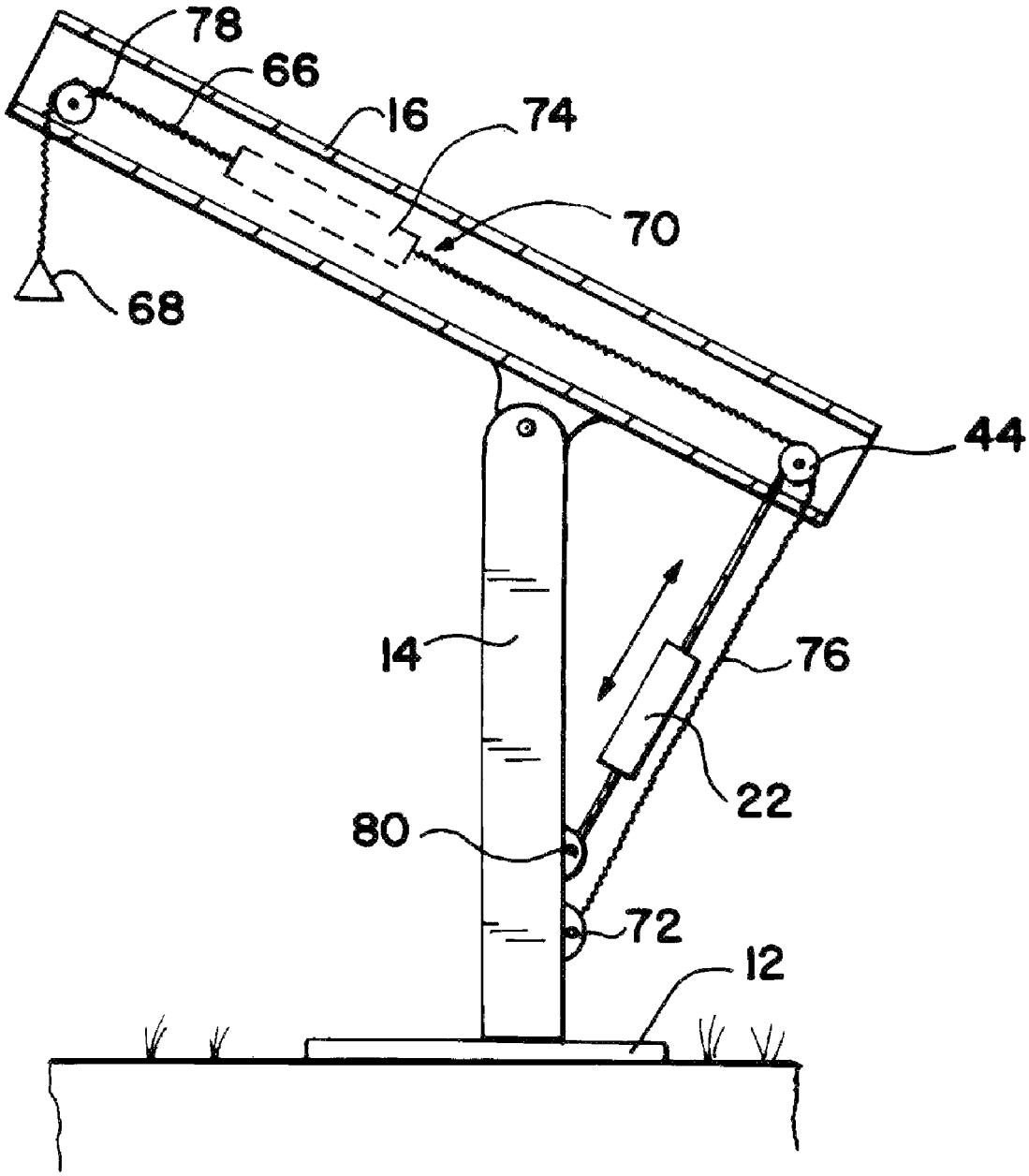
FIG. 5 is a partially schematic depiction of a second embodiment of the invention.

Turning now to FIG. 5, one finds a somewhat simplified and more schematic depiction of a café umbrella support 10 of the invention that may be useful in understanding operation of the inventive apparatus. In the depiction of FIG. 5 a support-arm cable assembly 70 extends from a knot bead 68 at a free end of the cable to a tie-off point 72 on the upstanding pole 14. The cable assembly 70 may comprise a single cable, but preferably comprises both a runner cable 66 extending from the free end of the cable assembly to a pulley arrangement 74 as well as a tied-off cable 76 extending from the pulley arrangement 74 to a tie-off point 72 on the upstanding pole 14. Two idler pulleys 44, 78 are used to redirect the cable near respective ends of the support arm 16. A linear actuator 22, which may comprise the winch 26 and telescoping strut 24 discussed above, is connected between an anchor point 80 on the pole and another connection point 44 near the end of short portion of the support arm. Although the anchor points 80, 72 for the actuator and for the cable assembly are shown spaced apart in FIG. 5, the reader will appreciate that this is done in the interest of clarity of presentation. One can, of course, have both the cable assembly and the actuator anchored at the same height on the pole. In the preferred embodiment depicted in FIG. 3, for example, the tied-off end of the cable assembly 70 is tied-off to the winch base 38 at a location fairly close to the point at which the winch base 38 is pivotally connected to the pole 14.

Although preferred embodiments of the invention conceal most of the cable assembly 70 within tubular members 16, 24, 60, this is not a necessary feature. For example, if one chose to use a solid beam for the support arm 16, the suitable portions of the cable assembly could be attached to one of the sides of that beam.

Figure 1:
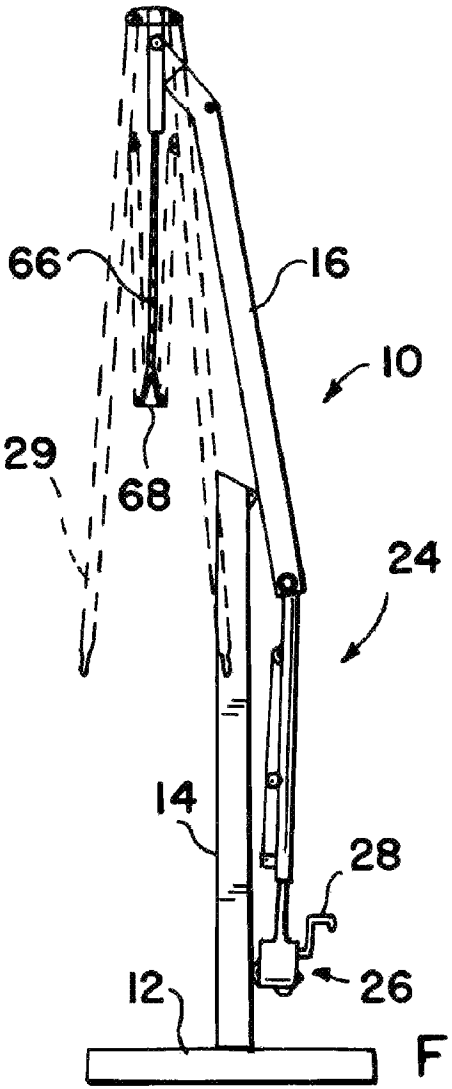
FIG. 1 is an elevational view of a preferred embodiment of the invention in a first limiting position in which a support arm portion of the apparatus is raised and a canopy that may be supported by the apparatus is closed.

In operation of the apparatus depicted in FIG. 5, when the actuator 22 is used to draw the shorter portion of the pivoted arm 16 toward the pole 14, the canopy supporting end 18 rises. At the same time, because the distance from the tied-off end of the cable assembly 70 to the arm 16 has decreased, the cable assembly allows the knot bead 68 to move away from the canopy supporting end 18 of the arm. Ultimately, this leads to the apparatus moving into the position shown in FIG. 1 in which the canopy is collapsed or closed. On the other hand, when the actuator allows or compels the short end of the arm to move away from the pole, the knot bead 68 moves toward the canopy supporting end of the support arm which opens the canopy, as depicted in FIG. 2.

The pulley arrangement 74 schematically depicted in FIG. 5 is designed to have a mechanical advantage of less than one so that a displacement of the tied-off end portion of the cable assembly results in a greater displacement of the knot bead end portion. There are many pulley arrangements that meet this criterion. Two are shown in FIGS. 6 and 7.

Figure 6:
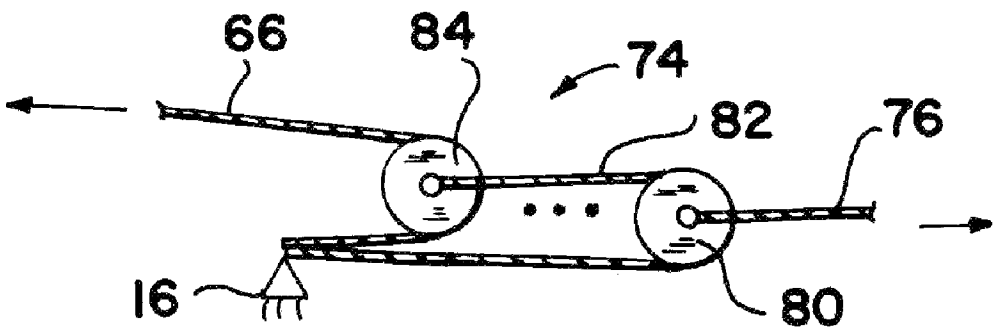
FIG. 6 is schematic depiction of a first pulley arrangement usable in the invention.

Turning now to FIG. 6, one finds a schematic depiction of a pulley arrangement 74 comprising two pulleys spaced out along the axis of the support arm. A tied-off end cable 76 is attached an axle (i.e., to a sheave that is not shown in the interest of clarity) of a first pulley 80. An intermediate cable 82 that engages the first pulley 80 has a first end tied-off to the support arm and a second end connected to the axle of the second pulley 84. One end of a runner cable 66 is anchored to the support arm. The runner cable 66 engages the second pulley 84 and extends to the knot bead 68 at the free end of the cable assembly 70.

Figure 7:
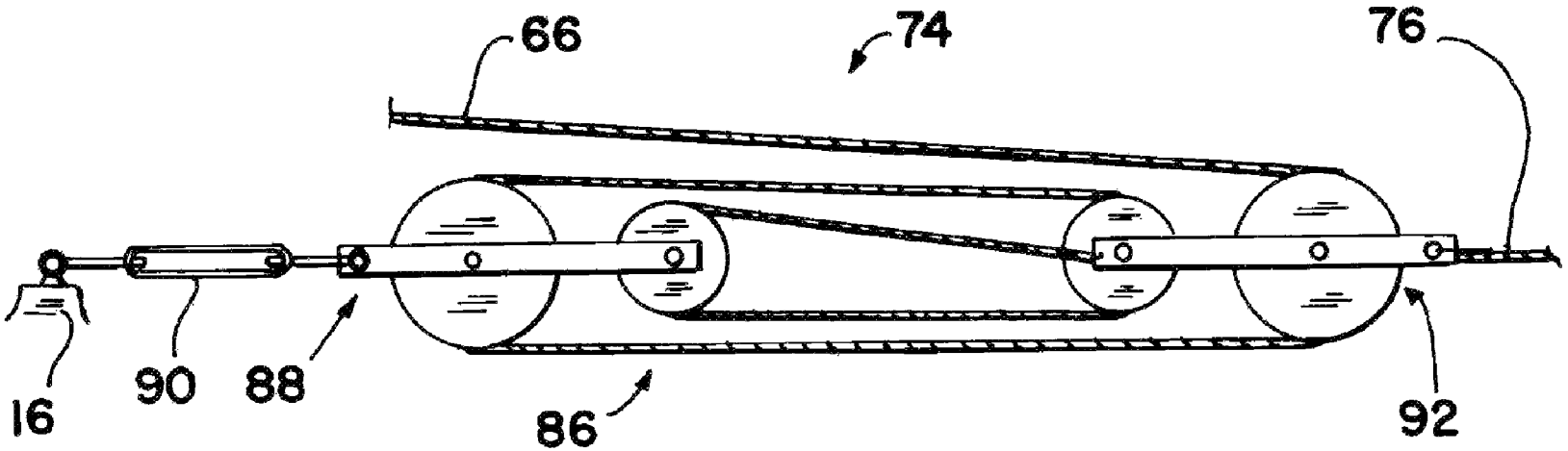
FIG. 7 is a schematic depiction of a second pulley arrangement usable in the invention.

A preferred pulley arrangement 74 is depicted schematically in FIG. 7. This arrangement comprises a block and tackle 86 having one block 88 anchored to the support arm 16 through a turnbuckle 90. The other block 92 is attached to both the tied-off 76 and runner 66 cables. The runner cable 66 engages all four depicted pulleys so that a selected displacement of the block 92 to which the tied-off 76 and runner cables 66 are attached results in five times that displacement at the knot-bead end of the runner cable 66. The reader will recognize that although the depiction of FIG. 7 shows a block and tackle having pulleys arranged in a line, rather than the more common arrangement of having pairs of pulleys juxtaposed on a common axle, this is done for purposes of clarity of presentation and that many sorts of block and tackle arrangements may be used for this purpose.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

I claim:

1. An umbrella supporting apparatus comprising:

an upstanding pole;

a support arm having two ends, the support arm pivotally attached to the pole adjacent an upper end thereof so that a longer portion of the arm extends outwardly from one side of the pole to a first, canopy supporting, end and a shorter portion of the arm extends outwardly from the other side of the pole to a second, actuator-connected, end;

an actuator mechanism connected between the pole and the shorter portion of the arm and operable to selectively raise or lower the canopy supporting end of the arm by moving the actuator-connected end of the arm respectively toward or away from the pole; and a support arm cable assembly comprising:

a tied-off cable having two ends, the first end of the tied-off cable tied-off to the pole, the second end of the tied-off cable attached to a first portion of a pulley arrangement, the first portion of the pulley arrangement movable along the support arm; and a runner cable having two ends, a free end of the runner cable depending from the support arm adjacent the canopy supporting end thereof, the runner cable engaging a second portion of the pulley arrangement attached to and not movable along the support arm;

wherein the pulley arrangement comprises a plurality of pulleys and is characterized in that a displacement of the first portion thereof is accompanied by a greater displacement of the free end of the runner cable.

2. The umbrella supporting apparatus of claim 1 wherein the actuator mechanism comprises a winch pivotally attached to the pole and a winch cable assembly, distinct from the support arm cable assembly, the winch cable assembly attaching the winch to the shorter portion of the arm adjacent the actuator-connected end thereof.

3. The umbrella supporting apparatus of claim 1 wherein the first portion of the pulley arrangement comprises a movable pulley block and the second portion of the pulley arrangement comprises a fixed pulley block, each pulley block comprising at least one respective pulley, wherein the runner cable engages all of the pulleys in both the movable pulley block and the fixed pulley block, and wherein both the second end of the runner cable and the movable end of the tied-off cable are directly connected to the movable pulley block.

4. An umbrella supporting apparatus for supporting a canopy, the apparatus comprising:

an upstanding pole;

a tubular support arm having two ends, the support arm pivotally attached to the pole at an arm attachment point adjacent an upper end thereof so that a longer portion of the arm extends outwardly from one side of the pole to a first, canopy-supporting, end of the arm and a shorter portion of the arm extends outwardly from the other side of the pole-to a second end;

a winch comprising a winch spool journaled for rotation about a winch axle fixedly connected to a base that is pivotally attached to the pole below the support-arm attachment point; the winch operatively connected by a winch cable assembly to the shorter portion of the arm for selectively moving the shorter portion of the arm toward and away from the pole;

a support arm cable assembly, distinct from the winch cable assembly and comprising:

a tied-off cable having two ends, the first end of the tied-off cable tied-off to the winch base, the second, movable, end attached to a first selected point on a pulley arrangement; and a runner cable having two ends, a free end of the runner cable depending from the support arm adjacent the canopy supporting end thereof, the second end of the runner cable attached to a second selected point on the pulley arrangement;

wherein the pulley arrangement comprises a plurality of pulleys and is characterized in that a selected displacement of the first selected point is accompanied by a greater displacement of the free end of the runner cable.

5. The apparatus of claim 4 further comprising a first idler pulley adjacent the second end of the support arm, the first idler pulley engaged by the tied-off cable, and a second idler pulley adjacent the canopy-supporting end of the support arm, the second idler pulley engaged by the runner cable.

6. The apparatus of claim 4 wherein the pulley arrangement comprises two pulley blocks and wherein each pulley block comprises two respective pulleys.

7. The apparatus of claim 4 further comprising a telescopable strut having a lower portion affixed to the winch and an upper portion pivotally attached to the support arm adjacent the second end thereof.

8. The apparatus of claim 4 wherein the winch is rotatable in a first and a second rotary sense, and wherein the winch cable assembly comprises:

a first winch cable arranged to draw the shorter portion of the support arm toward the pole when the winch is rotated in the first rotary sense; and a second winch cable connected to a telescopable strut so as to draw the telescopable strut into an extended position when the winch is turned in the second rotary sense.

9. The apparatus of claim 4 wherein the pulley arrangement is disposed within the support tube.

10. An apparatus for supporting a canopy, the apparatus comprising:

an upstanding pole;

a support arm having two ends and pivotally attached to the pole adjacent an upper end thereof so that a longer portion of the support arm extends outwardly from one side of the pole to a first, canopy supporting, end and a shorter portion of the support arm extends outwardly from another side of the pole to a second end;

an actuator mechanism connected between the pole and the shorter portion of the support arm and operable to selectively raise or lower the canopy supporting end of the support arm by moving the second end of the support arm respectively toward or away from the pole; and a cable assembly comprising a plurality of pulleys and a runner cable having a free end depending from the support arm adjacent the canopy supporting end thereof, a movable pulley of the plurality thereof tied to the pole by means of a tied-off cable distinct from the runner cable and having a fixed length so that the movable pulley is moved toward the second end of the support arm when the actuator mechanism moves the second end of the support arm away from the pole, the cable assembly characterized by a mechanical advantage of less than one so that a displacement of the movable pulley is accompanied by a greater displacement of the free end of the runner cable.

* * * * *